US005405187A

United States Patent [19]

Söderlund

[11] Patent Number: 5,405,187

[45] Date of Patent: Apr. 11, 1995

[54] WHEELCHAIR WHERE THE SEAT IS DIVIDED LONGITUDINALLY

[76] Inventor: Bengt Söderlund, Nybrogatan 44, S-114 40 Stockholm, Sweden

[21] Appl. No.: 50,211

[22] PCT Filed: Nov. 8, 1991

[86] PCT No.: PCT/SE91/00755

§ 371 Date: May 6, 1993

§ 102(e) Date: May 6, 1993

[87] PCT Pub. No.: WO92/08430

PCT Pub. Date: May 29, 1992

[30] Foreign Application Priority Data

Nov. 8, 1990 [SE] Sweden ..... 9003561

[51] Int. Cl.[6] ..... A61G 5/00

[52] U.S. Cl. ..... 297/312; 297/331; 297/344.19; 297/344.21; 297/452.39; 5/81.1; 5/86.1

[58] Field of Search ..... 297/312, DIG. 4, 331, 297/344.21, 344.19, 452.39; 5/81.1, 86.1, 619

[56] References Cited

U.S. PATENT DOCUMENTS

| | | | |
|---|---|---|---|
| 439,088 | 10/1890 | Allen | 5/619 X |
| 3,882,555 | 5/1975 | Edlund | 5/89 X |
| 5,098,158 | 3/1992 | Palarski | 297/312 X |
| 5,148,559 | 9/1992 | Morris | 5/86.1 |

FOREIGN PATENT DOCUMENTS

| | | |
|---|---|---|
| 0372839 | 6/1990 | European Pat. Off. . |
| 2113086 | 8/1983 | United Kingdom . |
| 82/01313 | 4/1984 | WIPO . |

*Primary Examiner*—Peter R. Brown
*Attorney, Agent, or Firm*—Nies, Kurz, Bergert & Tamburro

[57] ABSTRACT

A wheelchair for handicapped people includes a frame structure which is carried by chair-rolling devices and which in turn carries a seat and back-support. The wheelchair is characterized in that the seat is divided longitudinally, preferably along a center line, and in that the seat parts are so journalled to the frame structure as to enable the seat parts to be swung outwardly on respective sides of the wheelchair, independently of one another.

6 Claims, 2 Drawing Sheets

WHEELCHAIR WHERE THE SEAT IS DIVIDED LONGITUDINALLY

The present invention relates to a wheelchair for the handicapped, comprising a frame structure which is carried by chair-rolling devices and which supports a chair seat.

It is known that handicapped people find it difficult to climb from their bed into a wheelchair and to climb from the wheelchair onto a toilet or water closet. In the case of younger people with well-developed muscles, this problem is overcome relatively easily for a number of years, although with time the shoulder muscles of the person concerned are liable to become strained and tired therewith often requiring the assistance of a nurse or like attendant, particularly as the weight of the handicapped person increases.

The present invention relates to a wheelchair which provides a solution to the aforesaid problem and enables handicapped persons to move into and from the wheelchair without appreciable effort.

The invention thus relates to a wheelchair for the handicapped, comprising a frame structure which is carried by chair-rolling devices and which, in turn, carries a seat and back-supporting means.

The wheelchair is mainly characterized in that the seat is divided in its longitudinal direction, preferably along a centre line, and is so journalled to the frame structure that the separate parts of the seat can be swung out on respective sides of the frame, independently of one another.

The invention will now be described in more detail with reference to an exemplifying embodiment thereof and also with reference to the accompanying drawings, in which FIG. 1 is a vertical, central longitudinal section view through a first embodiment of an inventive wheelchair whose frame structure is constructed so as to enable the chair to be moved over a bed while enabling, at the same time, part of the chair to be inserted beneath the bed;

Figure 1:
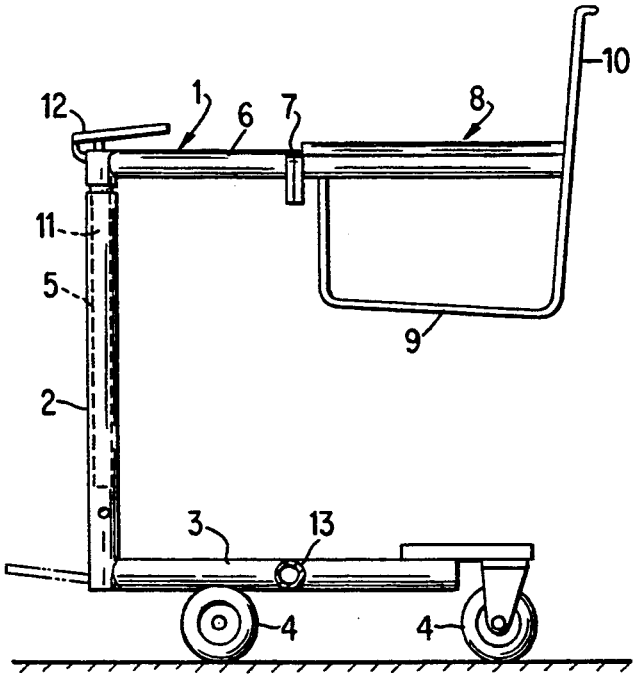
Figure 2:
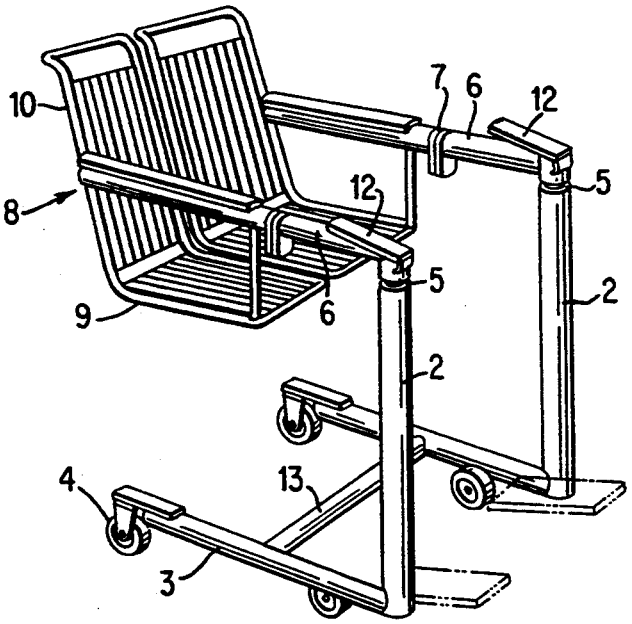
FIG. 2 illustrates the wheelchair of FIG. 1 in perspective.

Shown in FIG. 1 is a frame structure 1 of which one-half is shown in the Figure and of which each half includes a vertical part 2 which is connected to a substantially horizontal lower part 3 supported on casters 4. A moveable periscope-like part 5 of the vertical frame part 2, such as a tubular part 5, is connected to a substantially horizontal upper frame part 6, which is pivotally connected to a seat member 9 forming part of the seat 8 of the wheelchair by means of appropriate hinge devices 7. The seat member 9 is, in turn, connected to a back-support member 10 connected to in the wheelchair seat.

Figure 3:
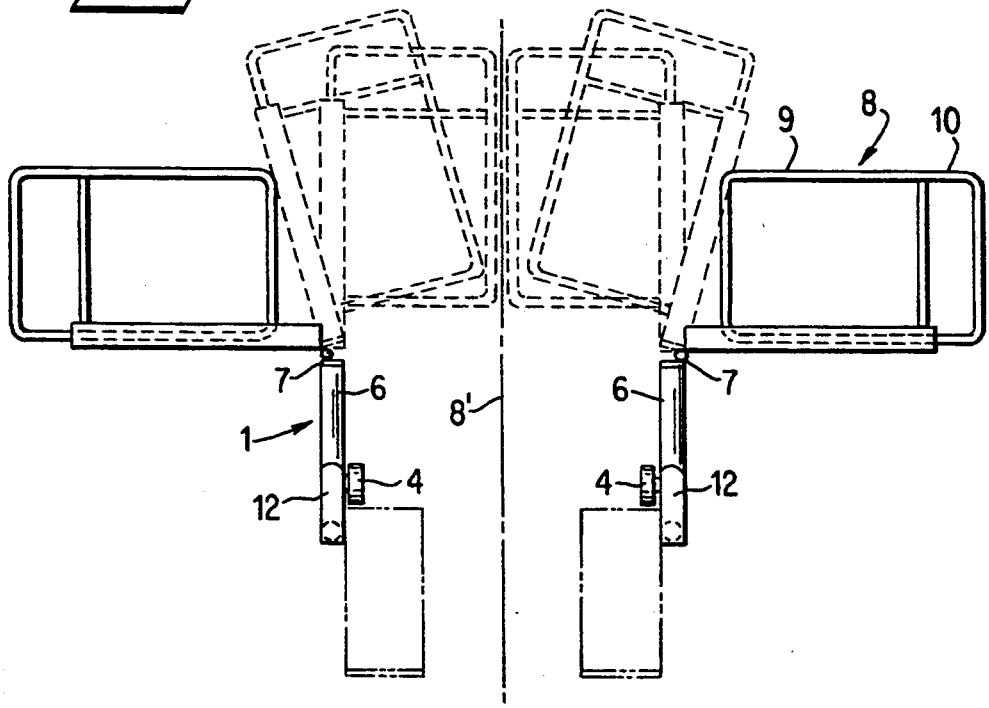
FIG. 3 illustrates the wheelchair shown in FIG. 1 seen from above in said Figure and shows the seat members in a fully outwardly swung position, and also shows in broken lines the seat members in a fully combined position and a partially outwardly swung position.
Figure 4:
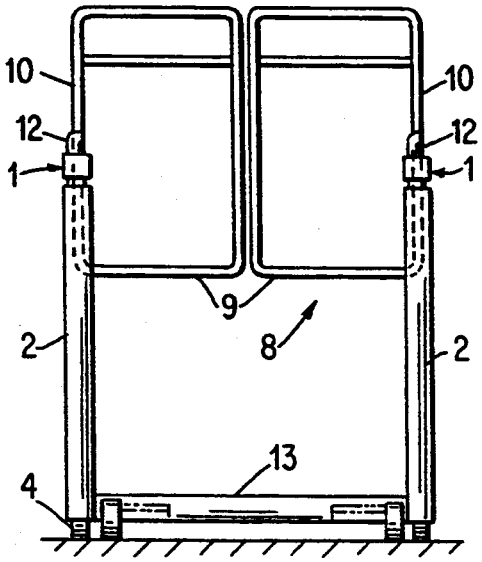
FIG. 4 illustrates the wheelchair of FIG. 1 seen from the left in said Figure, and shows the seat with both seat members positioned at mutually the same height.
Figure 5:
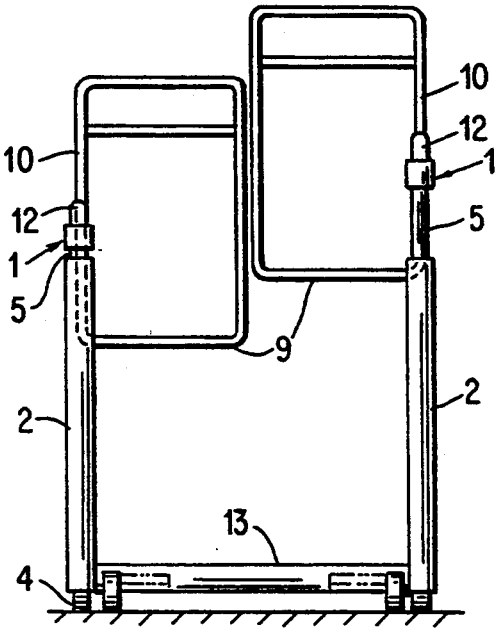
FIG. 5 illustrates the wheelchair of FIG. 4, with one seat member raised above the other.

The wheelchair seat is thus divided into two seat components in the longitudinal direction of the wheelchair, preferably along a centre line 8' in FIG 3, each seat part comprising together two seat components and two back-support components, said seat components with connecting back-support components being capable of being swung independently to respective sides of the wheelchair, as illustrated in FIG. 3. According to one preferred embodiment of the invention, the seat components, when brought partially together, can substitute for a toilet seat.

Respective seat parts can be raised and lowered independently of each other. In the case of the illustrated embodiment, there is arranged in each of the moveable pericope-like parts 5 a blockable gas spring 11 provided with a manipulating knob 12 by means of which the parts 5 can be locked in selected positions. The lifting force exerted by each spring will preferably correspond essentially to half of the weight of a patient. It is also conceivable to raise and lower the seat parts with the aid of electric motors.

Figure 6:
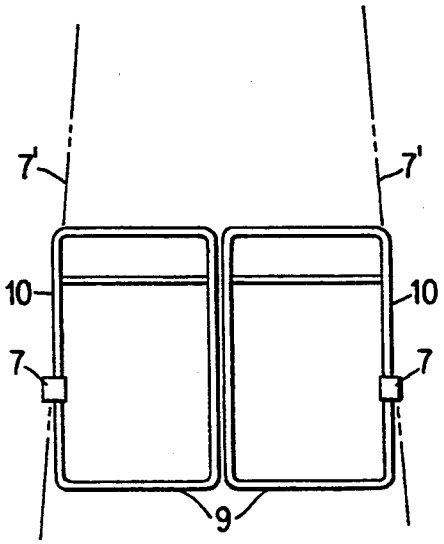
FIG. 6 illustrates a partial front view showing seat and hinge components illustrating the obliquely positioned hinged axes.

According to one preferred embodiment of the invention, the hinge devices 7, as shown in FIG. 6, are mounted with their axis 7' obliquely positioned, i.e., slightly inclined from a vertical disposition, with an upward convergence, when viewed from the front of the wheelchair, so that the seat members 9 will be raised when swung outwards and will fall into place when swung inwards.

The reference 13 identifies a cross strut which connects the two sides of the frame structure.

According to one preferred embodiment, the seat and the frame structure are arranged so that a lower part of the frame can be inserted beneath a bed, sofa, toilet or like sitting and/or lying arrangement with the seat positioned above the same. In this case, it is preferred that the frame structure and the seat form a substantially horizontal, U-shaped configuration, of which the seat and, when appropriate, an upper part of the frame structure or the lower part of the frame structure form the legs of said configuration.

The manner in which the inventive wheelchair operates will be understood in all essentials from the aforegoing. When a person wishes to leave the bed or the like, it is assumed that he or she is able to sit up and to turn so as to be seated across the bed with his or her feet resting on the floor. The wheelchair, which is within easy reach, is moved in over the bed, with the seat and back-support members swung outwards. By shifting his or her body weight from one side to the other, the patient is able to move the seat members 9 in beneath his or her body, first on one side and then on the other. The person is then able to lift himself or herself free from the bed, with the aid of the gas springs or like devices. The procedure is essentially the same in the case of other seating and/or lying arrangements.

It will be evident from the aforegong that the wheelchair will enable nursing personnel to move a patient from a bed to a toilet, and vice versa, without needing to lift the patient. If the wheelchair is fitted with motor-driven wheels, the patient is able to manage by himself, without assistance.

Although the invention has been described with reference to exemplifying embodiments thereof, it will be understood that changes and modifications can be made without departing from the concept of the invention.

I claim:

1. A wheelchair comprising a support frame structure, supported on rolling devices, and carrying a seat means with back support structure, said seat means and back support structure being divided longitudinally along a vertical center plane into two seat units, each seat unit comprising a seat member and a back-support member connected to the seat member; said frame structure comprising: two spaced-part elongate vertical frame means, with lower and upper ends, one of said vertical frame means being disposed at each side of the wheel chair; two lower elongate, spaced-apart essentially horizontal frame parts, individual ones of said lower frame parts being connected to and extending rearwardly from the lower end of each vertical frame means; means extending between and rigidly joining said spaced-apart lower frame parts; two elongate upper, essentially horizontal frame parts, individual ones of which being connected to the upper end of each vertical frame means and extending rearwardly therefrom; the rearward portion of each upper frame part having a hinge means connected thereto with the axes of the hinge means being substantially vertical and the front of each one of said seat units being connected to the hinge means on an associated one of said upper frame parts; said hinge means enabling said seat units to be swung out about the respective substantially vertical hinge axes to respective sides of the frame structure to enable relative passage of a person into the wheelchair from the rear of the wheelchair.

2. A wheelchair according to claim 1, wherein the seat units can be swung about said associated hinge means to partially open in a manner to provide a configuration which can substitute for a toilet seat.

3. A wheelchair according to claim 1, wherein means in said vertical frame means, which connect said seat units to said two lower frame parts enable said respective seat units to be raised and lowered relative to said frame structure, independently of one another.

4. A wheelchair according to claim 3, wherein a blockable gas spring is secured in each of said vertical frame means and is connected between the associated vertical frame means and its associated upper frame part whereby said upper frame parts and the associated seat units can be raised and lowered by said blockable gas springs (11), the lifting force of each gas spring corresponding essentially to half of the weight of a patient sitting in said wheelchair.

5. A wheelchair according to claim 1, wherein said hinge means (7) have their axes positioned obliquely to diverge slightly from a vertical disposition so that the seat units will rise when swung outwardly and will fall into place and therewith lower when swung inwardly.

6. A wheelchair according to claim 1, wherein said frame structure (1) and said seat means in side elevation define a substantially U-shaped configuration, where the seat (8) and upper parts of the frame structure and the lower parts of said frame structure form rearwardly disposed legs of said U-shaped configuration, whereby the lower frame parts can be inserted beneath a patient support item with the seat means positioned above the support item, said support item being one of a group of support items including, a bed, sofa, toilet which can support a patient.

* * * * *